US010205235B2

(12) United States Patent
Athley et al.

(10) Patent No.: US 10,205,235 B2
(45) Date of Patent: Feb. 12, 2019

(54) WIRELESS COMMUNICATION SYSTEM NODE WITH RE-CONFIGURABLE ANTENNA DEVICES

(71) Applicant: TELEFONAKTIEBOLAGET LM ERICSSON (PUBL), Stockholm (SE)

(72) Inventors: Fredrik Athley, Kullavik (SE); Martin Johansson, Mölndal (SE); Andreas Nilsson, Göteborg (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 63 days.

(21) Appl. No.: 15/100,945

(22) PCT Filed: Dec. 4, 2013

(86) PCT No.: PCT/EP2013/075590
§ 371 (c)(1),
(2) Date: Jun. 1, 2016

(87) PCT Pub. No.: WO2015/082000
PCT Pub. Date: Jun. 11, 2015

(65) Prior Publication Data

US 2016/0308279 A1 Oct. 20, 2016

(51) Int. Cl.
*H01Q 3/24* (2006.01)
*H01Q 3/30* (2006.01)
(Continued)

(52) U.S. Cl.
CPC ..... *H01Q 3/30* (2013.01); *H01Q 1/246* (2013.01); *H01Q 3/28* (2013.01); *H01Q 5/00* (2013.01); *H01Q 21/26* (2013.01)

(58) Field of Classification Search
CPC ..... H01Q 21/28; H01Q 21/29; H01Q 25/00; H01Q 21/00; H01Q 3/22; H01Q 3/24; H01Q 3/26
(Continued)

(56) References Cited

U.S. PATENT DOCUMENTS 5,151,706 A * 9/1992 Roederer ..... H01Q 3/40 342/372
6,469,680 B1 * 10/2002 Kelliher ..... H04B 7/10 343/725
(Continued)

FOREIGN PATENT DOCUMENTS

EP 0915529 A1 5/1999
WO 200205383 A1 1/2002
WO 2014206443 A1 12/2014

OTHER PUBLICATIONS

International Search Report and Written Opinion dated Aug. 4, 2014, in International Application No. PCT/EP2013/075590, 9 pages.

*Primary Examiner* — Dameon E Levi
*Assistant Examiner* — Hasan Z Islam
(74) *Attorney, Agent, or Firm* — Rothwell, Figg, Ernst & Manbeck, P.C.

(57) ABSTRACT

The invention relates to a node in a wireless communication system, where the node comprises at least one antenna arrangement. Each antenna arrangement comprises a first, second, third and fourth antenna device positioned one after the other. Each antenna device comprises at least a corresponding first antenna port connected to a first polarization of the corresponding antenna device, the first antenna device and the second antenna device forming a first antenna device pair, and the third antenna device and the fourth antenna device forming a second antenna device pair. For each antenna device pair, the first antenna ports are at least
(Continued)

indirectly connected to at least one respective controllable power divider/combiner having a respective common port. Each controllable power divider/combiner is arranged to adjust and/or set a corresponding power relation between the first antenna ports of the corresponding antenna device pair for power received and/or transmitted at its common port.

12 Claims, 7 Drawing Sheets

(51) Int. Cl.

| | |
|---|---|
| ***H01Q 1/24*** | (2006.01) |
| ***H01Q 3/28*** | (2006.01) |
| ***H01Q 5/00*** | (2015.01) |
| ***H01Q 21/26*** | (2006.01) |

(58) Field of Classification Search
USPC ..... 343/757, 758, 853, 893, 754
See application file for complete search history.

(56) References Cited

U.S. PATENT DOCUMENTS

| | | | | |
|---|---|---|---|---|
| 6,992,638 | B2 * | 1/2006 | du Toit | H01Q 3/242 343/711 |
| 8,390,518 | B2 * | 3/2013 | Haustein | H01Q 21/24 343/700 MS |
| 2005/0012665 | A1 * | 1/2005 | Runyon | H01Q 1/246 342/372 |
| 2009/0066595 | A1 * | 3/2009 | Barker | H01Q 1/246 343/757 |

* cited by examiner

WIRELESS COMMUNICATION SYSTEM NODE WITH RE-CONFIGURABLE ANTENNA DEVICES

CROSS REFERENCE TO RELATED APPLICATION(S)

This application is a 35 U.S.C. § 371 National Phase Entry Application from PCT/EP2013/075590, filed Dec. 4, 2013, designating the United States, the disclosure of which is incorporated herein in its entirety by reference.

TECHNICAL FIELD

The present invention relates to a node in a wireless communication system where the node comprises at least one antenna arrangement. Each antenna arrangement in turn comprises a first antenna device, a second antenna device, a third antenna device and a fourth antenna device positioned one after the other. The antenna devices have corresponding phase centers which are separated by corresponding distances. Each antenna device comprises at least a corresponding first antenna port connected to a first polarization of the corresponding antenna device. The first antenna device and the second antenna device form a first antenna device pair, and the third antenna device and the fourth antenna device form a second antenna device pair.

BACKGROUND

In current wireless communication systems such as LTE (Long Term Evolution) and HSPA (High Speed Packet Access), multi-antenna systems are used to increase capacity, coverage, and link reliability.

Future generations of cellular networks are expected to provide high data rates, up to 10 Gbps, while at the same time being energy efficient. One promising but relatively unexplored way to achieve such high data rates and/or to lower the energy consumption in cellular networks is to deploy reconfigurable antenna systems. A reconfigurable antenna system is an antenna system whose radiation characteristics can be changed by the network after deployment and adapted to, e.g., current traffic needs. For example, the antenna system can be reconfigured to better serve a traffic hotspot by, e.g., increasing the antenna gain toward the hotspot location.

Furthermore, there may be first type of beams for sector coverage where control and system information are transmitted, e.g., BCH (broadcast channel) and CRS (cell-specific reference signal) in LTE. Since these signals need to reach all users in a cell, they have to be transmitted with a sufficiently wide beam that covers the desired area. The beam should also be sufficiently narrow in order not to transmit too much interference into neighboring sectors. Typically, a beam with 65° half-power beamwidth (HPBW) is used for 3-sector sites, since this provides a good balance between the two conflicting requirements mentioned previously.

A second type of beams then relates to beams for user-specific data transmission, e.g., PDSCH (physical downlink shared channel) in LTE. These beams should be narrow in order to maximize the gain to the intended user and also to minimize the interference transmitted to other users.

Passive reconfigurable antennas typically contain two or more columns of antenna elements to be able to electrically change the beamwidth (BW) and/or beam pointing direction (BPD) in azimuth. Two or more such reconfigurable antennas can be combined into an antenna array that can be used for user-specific beamforming, spatial multiplexing, and other multi-antenna techniques. The phase center of each reconfigurable antenna in such an array is typically static and located in the middle of the reconfigurable antenna aperture. However, when using reconfigurable antennas to change the sector width in combination with codebook based precoding it is important to also adjust the phase center separation so that the codebook beams are matched to the new sector width.

With a traditional base station antenna, sector coverage is typically provided by a column of radiating elements connected via a feed network to a physical antenna port. The azimuth radiating pattern of the sector-covering beam is in this case given by the individual radiating element. Several such columns can then be assembled adjacent to each other to form an antenna array in the horizontal dimension. By applying beamforming weights to this array, user-specific beams can be created. In LTE, several transmission modes have been specified that make use of user-specific beamforming. One example is transmission mode 4 (TM4) where beamforming weights are selected from a set of predefined weights in a codebook, so called codebook-based precoding.

The flexibility in the sector beam generation can be utilized for sector shape reconfiguration when changes occur in the network such as changes in deployment or spatial traffic distribution, e.g., new sites, buildings, or traffic hotspots. It is well known that such reconfiguration can give substantial improvements in system performance.

It is therefore a desire to provide a node in a wireless communication system that comprises an antenna arrangement that enables changing of the sector width in wireless cellular networks, where all beams are matched to the new sector width.

SUMMARY

It is an object of the present invention to provide a node in a wireless communication system, where the node has an antenna arrangement that enables changing of the sector width in wireless cellular networks where all beams are matched to the new sector width.

Said object is obtained by means of a node in a wireless communication system where the node comprises at least one antenna arrangement. Each antenna arrangement in turn comprises a first antenna device, a second antenna device, a third antenna device and a fourth antenna device positioned one after the other. The antenna devices have corresponding phase centers which are separated by corresponding distances. Each antenna device comprises at least a corresponding first antenna port connected to a first polarization of the corresponding antenna device. The first antenna device and the second antenna device form a first antenna device pair, and the third antenna device and the fourth antenna device form a second antenna device pair.

For each antenna device pair, the first antenna ports are at least indirectly connected to at least one respective controllable power divider/combiner having a respective common port. Each controllable power divider/combiner is arranged to adjust and/or set a corresponding power relation between the first antenna ports of the corresponding antenna device pair for power received and/or transmitted at its common port.

According to an example, a first power relation between the first antenna port of the first antenna device and the first antenna port of the second antenna device equals a second power relation between the first antenna port of the fourth antenna device and the first antenna port of the third antenna device. Each power relation is related to power received and/or transmitted at the respective common port.

According to another example, the first antenna ports of the first antenna device pair are at least indirectly connected to a first controllable power divider/combiner having a first common port. Furthermore, the first antenna ports of the second antenna device pair are at least indirectly connected to a second controllable power divider/combiner having a second common port.

According to another example, the first antenna port of the first antenna device is at least indirectly connected to the first controllable power divider/combiner and a third controllable power divider/combiner having a third common port, via a first filter device. The first filter device is arranged to, on one hand, transfer signals of a first frequency band between the first antenna port of the first antenna device and the first controllable power divider/combiner and, on the other hand, transfer signals of a second frequency band between the first antenna port of the first antenna device and the third controllable power divider/combiner.

Also, the first antenna port of the second antenna device is at least indirectly connected to the first controllable power divider/combiner and the third controllable power divider/combiner via a second filter device. The second filter device is arranged to, on one hand, transfer signals of the first frequency band between the first antenna port of the second antenna device and the first controllable power divider/combiner and, on the other hand, transfer signals of the second frequency band between the first antenna port of the second antenna device and the third controllable power divider/combiner.

Furthermore, the first antenna port of the third antenna device is at least indirectly connected to the second controllable power divider/combiner and a fourth controllable power divider/combiner having a fourth common port, via a third filter device. The third filter device is arranged to, on one hand, transfer signals of the first frequency band between the first antenna port of the third antenna device and the second controllable power divider/combiner and, on the other hand, transfer signals of the second frequency band between the first antenna port of the third antenna device and the fourth controllable power divider/combiner.

Finally, the first antenna port of the fourth antenna device is at least indirectly connected to the second controllable power divider/combiner and the fourth controllable power divider/combiner, via a fourth filter device. The fourth filter device is arranged to, on one hand, transfer signals of the first frequency band between the first antenna port of the fourth antenna device and the second controllable power divider/combiner and, on the other hand, transfer signals of the second frequency band between the first antenna port of the fourth antenna device and the fourth controllable power divider/combiner.

According to another example, each common port is connected to a corresponding end filter device. Each end filter device is arranged to transfer signals of a first frequency band between the respective common port and a respective first end filter port, and to transfer signals of a second frequency band between the respective common port and a respective second end filter port.

According to another example, for the first antenna pair, there is at least a first phase shifter connected to an antenna port, and for the second antenna pair, there is at least a second phase shifter connected to an antenna port.

According to another example, each antenna device comprises a corresponding second antenna port connected to a second polarization of the corresponding antenna device, where the first polarization and the second polarization are mutually orthogonal. For each antenna device pair, the second antenna ports are at least indirectly connected to a respective controllable power divider/combiner having a respective common port. Each controllable power divider/combiner is arranged to adjust and/or set a corresponding power relation between the second antenna ports of the corresponding antenna device pair for power received and/or transmitted at its common port.

All examples above for the first antenna port are applicable for the second antenna port as well, as disclosed in the relevant dependent claims.

A number of advantages are obtained by means of the present invention. Mainly, a passive antenna architecture is provided where beamwidth and phase center separation is controlled by means of an uncomplicated phase shift. The general performance and the possibility of performing correct DOA-estimations are increased.

The coupling between beamwidth and phase center separation is automatic, such that a change in beamwidth produces a desired change in phase center separation, and vice versa.

Further, an automatic suppression of grating lobes is acquired.

BRIEF DESCRIPTION OF THE DRAWINGS

The present invention will now be described more in detail with reference to the appended drawings, where.

DETAILED DESCRIPTION

Figure 1:
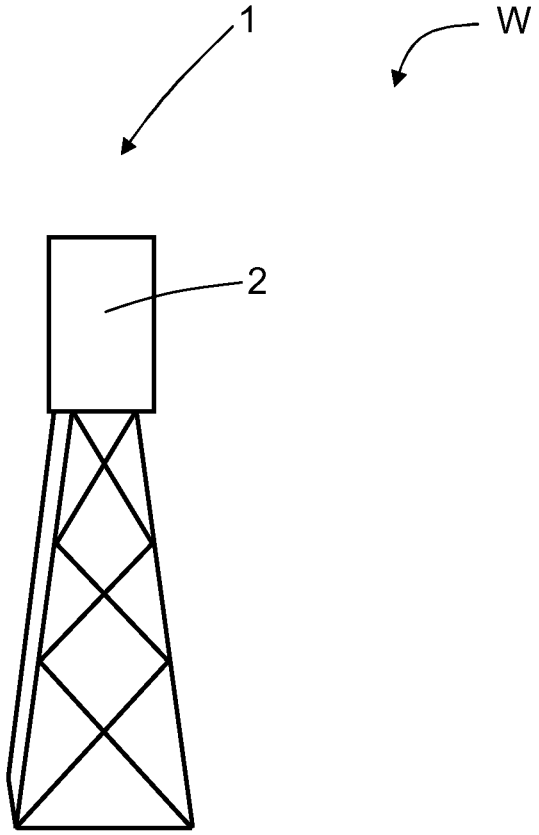
FIG. 1 shows a schematical view of a node in a wireless communication system.
Figure 4:
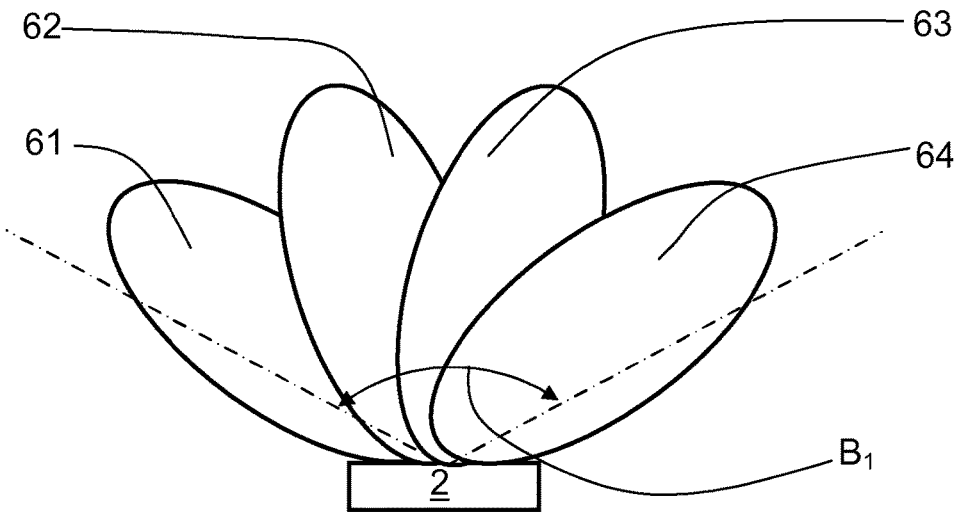
FIG. 4 shows a schematical example of a first sector width.
Figure 5:
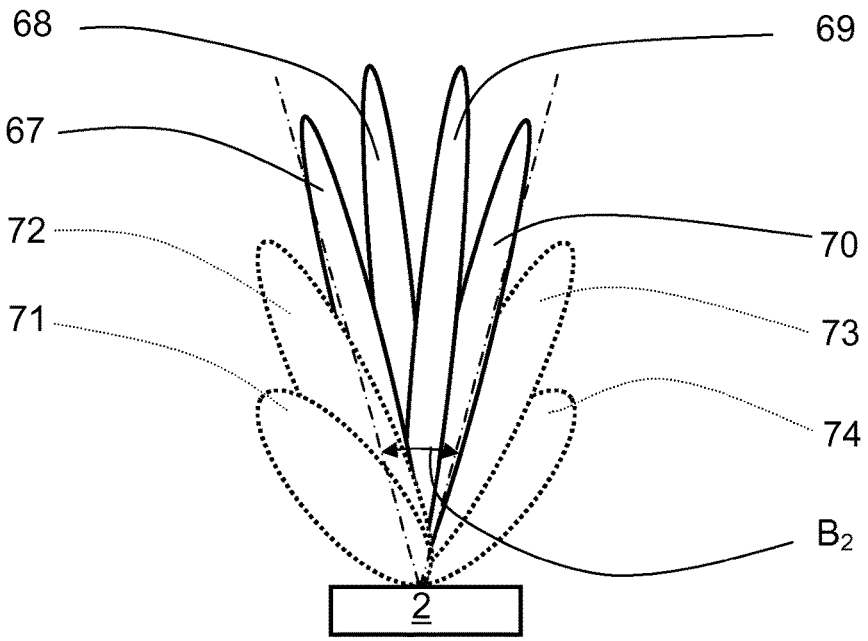
FIG. 5 shows a schematical example of a second sector width.

With reference to FIG. 1, there is a node 1 in a wireless communication arrangement W the node comprising an antenna arrangement 2, where the antenna arrangement 2 is adapted to cover a certain sector in an azimuth plane which lies perpendicular to the plane of the paper in FIG. 1. Examples of sectors are shown in FIG. 4 and FIG. 5, which will be described later.

Figure 2:
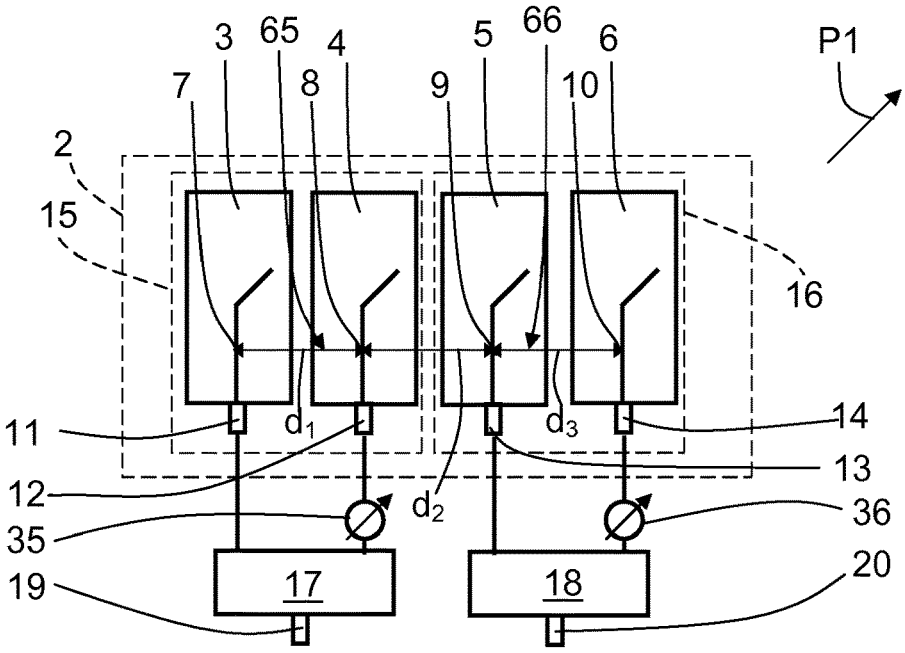
FIG. 2 shows a schematical view of an antenna arrangement according to a first example of the present invention.

With reference to FIG. 2, showing a first example, the antenna arrangement 2 comprises a first antenna device 3, a second antenna device 4, a third antenna device 5 and a fourth antenna device 6. The antenna device 3, 4, 5, 6 are positioned in a row one after the other, where each antenna device 3, 4, 5, 6 has a corresponding first phase center 7, second phase center 8, third phase center 9 and fourth phase center 10.

Between the first phase center 7 and the second phase center 8 there is a first distance $d_1$; between the second phase center 8 and the third phase center 9 there is a second distance $d_2$; and between the third phase center 9 and the fourth phase center 10 there is a third distance $d_3$. For example, the distances $d_1$; $d_2$; $d_3$ have the same value and equals about 0.5λ, where λ is the wavelength in air corresponding to a chosen suitable frequency, for example a center frequency.

Each antenna element 3, 4, 5, 6 comprises a corresponding first antenna port 11, 12, 13, 14 connected to a first polarization P1 of the corresponding antenna device 3, 4, 5, 6. The first antenna device 3 and the second antenna device 4 form a first antenna device pair 15, and the third antenna device 5 and the fourth antenna device 6 form a second antenna device pair 16.

According to the present invention, for each antenna device pair 15, 16, the first antenna ports 11, 12; 13, 14 are at least indirectly connected to at least one respective controllable power divider/combiner 17, 18 having a respective common port 19, 20. Each controllable power divider/combiner 17, 18 is arranged to adjust and/or set a corresponding power relation R1, R2 between the first antenna ports 11, 12; 13, 14 of the corresponding antenna device pair 15, 16 for power received and/or transmitted at its common port 19, 20.

In the example of FIG. 2, the first antenna ports 11, 12 of the first antenna device pair 15 are connected to a first controllable power divider/combiner 17 having a first common port 19. Furthermore, the first antenna ports 13, 14 of the second antenna device pair 16 are connected to a second controllable power divider/combiner 18, having a second common port 20. The first antenna port 12 of the second antenna device 4 is connected to the first controllable power divider/combiner 17 via a first phase shifter 35, and the first antenna port 14 of the fourth antenna device 6 is connected to the second controllable power divider/combiner 18 via a second phase shifter 36. The phase shifters 35, 36 are used to change beam pointing direction (BPD) in azimuth.

By controlling the first controllable power divider/combiner 17 to have a first power relation R1 between the antenna devices 3, 4 in the first antenna device pair 15, it is possible to distribute power in different ways. This enables the resulting antenna beamwidth of the antenna devices 3, 4 in the first antenna device pair 15 at the first common port 19 to be controlled. For example, if the power is equal for these antenna devices 3, 4, a narrow beam will be created, and if all power is distributed to only one of these antenna devices 3, 4, a wide beam will be created. By gradually distributing the power from equal power for the first antenna device 3 and the second antenna device 4, to all power to either the first antenna device 3 or the second antenna device 4, the beamwidth will gradually change from a narrow beam to a wide beam. This is in turn due to the creation of a first combined virtual phase center 65 that has a controllable position. The position indicated in FIG. 2 is only an example.

Changing BPD by means of the first phase shifter 35 can for example be used when the beamwidth of the first antenna pair 15 is quite narrow, i.e. when the power is quite evenly distributed between both antenna devices 3, 4.

In the same way as described for the first antenna pair, the resulting antenna beamwidth of the antenna devices 5, 6 in the second antenna device pair 16 at the second common port 20 may be controlled by controlling a second power relation R2 at the second controllable power divider/combiner 18. The second phase shifter 36 may be used in the same way as the first phase shifter 35 as described above. Here, as well, a second combined virtual phase center 66 that has a controllable position is created. The position indicated in FIG. 2 is only an example.

Preferably, the first power relation R1, between the first antenna port 11 of the first antenna device 3 and the first antenna port 12 of the second antenna 4 device, equals the second power relation R2, between the first antenna port 14 of the fourth antenna device 6 and the first antenna port 13 of the third antenna device 5. Each power relation R1, R2 is related to power received and/or transmitted at the respective common port 19, 20.

By letting the power relations R1, R2 be equal to, or fall below, 0.5, the centrally placed second antenna device 4 and third antenna device 5 will always have the same or more power than the two other antenna devices 3, 6. In this way, the virtual combined phase centers 65, 66 of the antenna devices 3, 4, 5, 6 will be adapted to the beamwidth of the antenna devices 3, 4, 5, 6. For wide beamwidths, when only, or primarily, the centrally placed second antenna device 4 and third antenna device 5 are radiating, the separation between the first combined virtual phase center 65 and the second combined virtual phase center 66 will be on the order of 0.5λ, thus preventing grating lobe effects, which will enable non-ambiguous direction-of-arrival (DOA) estimation. This is illustrated in FIG. 4, where four antenna beams 61, 62, 63, 64 having a first combined beamwidth $B_1$ are shown.

For narrower beamwidths, when the other antenna devices 3, 6 are excited to a larger extent, the phase center separation between the first combined virtual phase center 65 and the second combined virtual phase center 66 is approximately 1λ. This is illustrated in FIG. 5, where four antenna beams 67, 68, 69, 70 having a second combined beamwidth $B_2$ are shown, the second combined beamwidth $B_2$ being narrower than the first combined beamwidth $B_1$. However, the phase center separation in this example generates grating lobes 71, 72, 73, 74, but the narrower beams 67, 68, 69, 70 of the radiation patterns suppress the grating lobes 71, 72, 73, 74 in the combined radiation pattern, and therefore the grating lobes 71, 72, 73, 74 will not affect the performance significantly.

In FIG. 4, the antenna beams 61, 62, 63, 64 may constitute user-specific beams, and in FIG. 5 the antenna beams 67, 68, 69, 70 may also constitute user-specific beams. The dense and narrow user specific beams 61, 62, 63, 64 in FIG. 5 are also desired due to reduced interference and increased gain.

An optimal beamwidth for three sector sites typically lies between 40-80°, and by using antenna devices 3, 4, 5, 6 connected to controllable power divider/combiners 17, 18 as described above, it is possible to create beams with such beamwidths.

If codebook based precoding is used, the phase center distance will also affect the pointing directions of the beams in the codebook.

Figure 3:
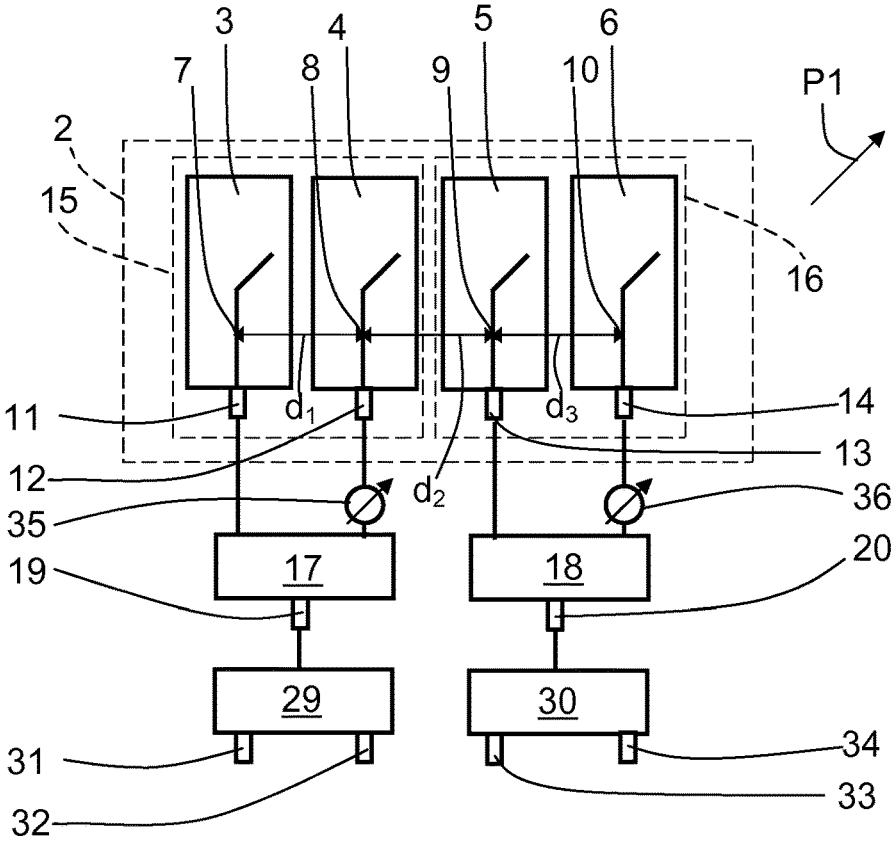
FIG. 3 shows a schematical view of an antenna arrangement according to a second example of the present invention.

According to a second example, with reference to FIG. 3, the first common port 19 is connected to a first end filter device 29, and the second common port 20 is connected to a second end filter device 30, each end filter device 29, 30 having a respective first end filter port 31, 33 and second end filter port 32, 34. Each end filter device 29, 30 is arranged to transfer signals of a first frequency band $f_1$ between the respective common port 19, 20 and the respective first end filter port 31, 33, and to transfer signals of a second frequency band $f_2$ between the respective common port 19, 20 and the respective second end filter port 32, 34. The first end filter ports 31, 33 may then be used for uplink signals, from user terminals to the node 1, and the second end filter ports 32, 34 may then be used for downlink signals, from the node 1 to user terminals. The uplink signals are then using the first frequency band $f_1$ and the downlink signals are then using the second frequency band $f_2$.

Figure 6:
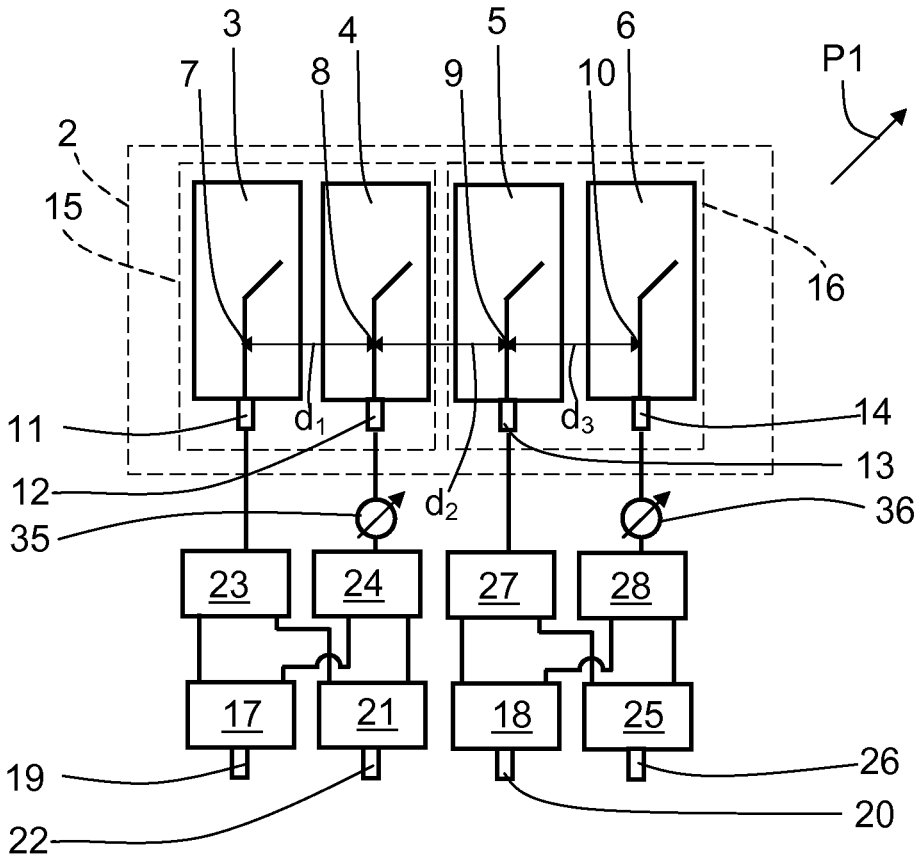
FIG. 6 shows a schematical view of an antenna arrangement according to a third example of the present invention.

According to a third example, with reference to FIG. 6, different controllable power divider/combiners are used for uplink signals and downlink signals, this arrangement could be used to achieve different phase center separations for uplink and downlink.

Here, the first antenna port 11 of the first antenna device 3 is connected to the first controllable power divider/combiner 17 and a third controllable power divider/combiner 21, having a third common port 22, via a first filter device 23. The first filter device 23 is arranged to, on one hand, transfer signals of a first frequency band $f_1$ between the first antenna port 11 of the first antenna device 3 and the first controllable power divider/combiner 17 and, on the other hand, transfer signals of a second frequency band $f_2$ between the first antenna port 11 of the first antenna device 3 and the third controllable power divider/combiner 21.

The first antenna port 12 of the second antenna device 4 is connected to the first controllable power divider/combiner 17 and the third controllable power divider/combiner 21 via a second filter device 24 and the first phase shifter 35 as described in the first example above. The second filter device 24 is arranged to, on one hand, transfer signals of the first frequency band $f_1$ between the first antenna port 12 of the second antenna device 4 and the first controllable power divider/combiner 17 and, on the other hand, transfer signals of the second frequency band $f_2$ between the first antenna port 12 of the second antenna device 4 and the third controllable power divider/combiner 21.

The first antenna port 13 of the third antenna device 5 is connected to the second controllable power divider/combiner 18 and a fourth controllable power divider/combiner 25, having a fourth common port 26, via a third filter device 27. The third filter device 27 is arranged to, on one hand, transfer signals of the first frequency band $f_1$ between the first antenna port 13 of the third antenna device 5 and the second controllable power divider/combiner 18 and, on the other hand, transfer signals of the second frequency band $f_2$ between the first antenna port 13 of the third antenna device 5 and the fourth controllable power divider/combiner 25.

The first antenna port 14 of the fourth antenna device 6 is connected to the second controllable power divider/combiner 18 and the fourth controllable power divider/combiner 25 via a fourth filter device 28 and the second phase shifter 36 as described in the first example above. The fourth filter device 28 is arranged to, on one hand, transfer signals of the first frequency band $f_1$ between the first antenna port 14 of the fourth antenna device 6 and the second controllable power divider/combiner 18 and, on the other hand, transfer signals of the second frequency band $f_2$ between the first antenna port 14 of the fourth antenna device 6 and the fourth controllable power divider/combiner 25.

The first common port 19 and the second common port 20 may then be used for uplink signals, and the third common port 22 and the fourth common port 26 may then be used for downlink signals, from the node 1 to user terminals. The uplink signals are then using the first frequency band $f_1$ and the downlink signals are then using the second frequency band $f_2$.

Figure 7:
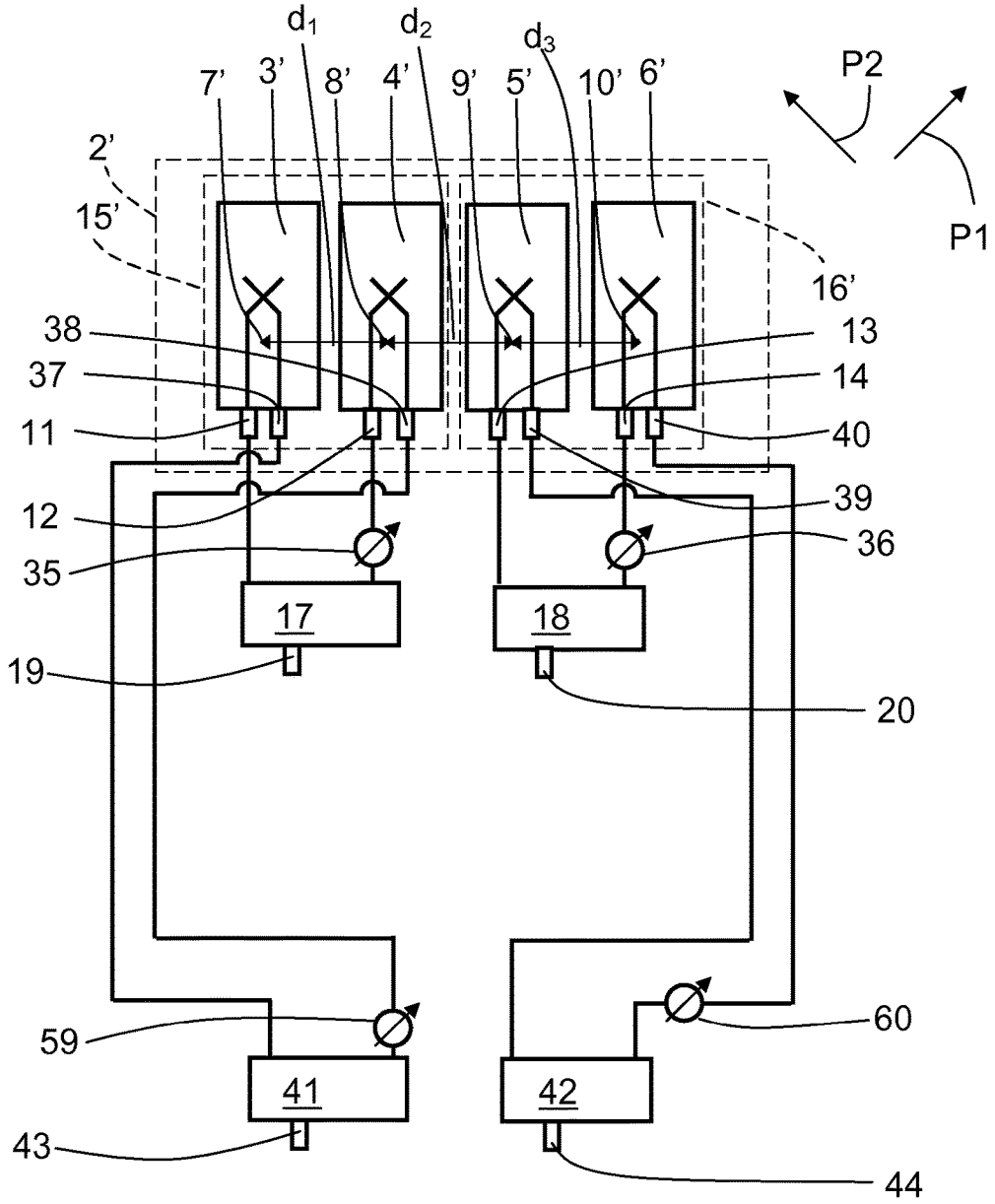
FIG. 7 shows a schematical view of an antenna arrangement according to a fourth example of the present invention.

According to a fourth example, with reference to FIG. 7, each antenna device 3', 4', 5', 6' comprises a corresponding second antenna port 37, 38, 39, 40 connected to a second polarization P2 of corresponding antenna devices 3', 4', 5', 6' with corresponding phase centers 7', 8', 9', 10'. The first polarization P1 and the second polarization P2 are mutually orthogonal. Here, all components that relate to the first polarization P1 are the same as for the first example, and have the same reference numbers. A first antenna device 3' and second antenna device 4' form a first antenna device pair 15', and a third antenna device 5' and fourth antenna device 6' form a second antenna device pair 16'

For each antenna device pair 15', 16', the second antenna ports 37, 38; 39, 40 are at least indirectly connected to a respective controllable power divider/combiner 41, 42 having a respective common port 43, 44. Each controllable power divider/combiner 41, 42 is arranged to adjust and/or set a corresponding power relation R3, R4 between the second antenna ports 37, 38; 39, 40 of the corresponding antenna device pair 15', 16' for power received and/or transmitted at its common port 43, 44.

More in detail, the second antenna ports 37, 38 of the first antenna device pair 15' are connected to a fifth controllable power divider/combiner 41 having a fifth common port 43, Furthermore, the second antenna ports 39, 40 of the second antenna device pair 16' are connected to a sixth controllable power divider/combiner 42, having a sixth common port 44. The second antenna port 38 of the second antenna device 4' is connected to the fifth controllable power divider/combiner 41 via a third phase shifter 59, and the second antenna port 40 of the fourth antenna device 6' is connected to the sixth controllable power divider/combiner 42 via a fourth phase shifter 60. As in the previous examples, these phase shifters 59, 60 are used to change BPD in azimuth.

Suitably, the power relations R3, R4 are arranged as for the previously described first power relation R1 and second power relation R2, such that a third power relation R3 between the second antenna port 37 of the first antenna device 3' and the second antenna port 38 of the second antenna device 4' equals a fourth power relation R4 between the second antenna port 40 of the fourth antenna device 6' and the second antenna port 39 of the third antenna device 5'. Each power relation R3, R4 is related to power received and/or transmitted at the respective common port 43, 44.

A fifth example below corresponds to the second example above, with the addition of components for the second polarization P2. All components that relate to the first polarization P1 are the same as for the second example, and have the same reference numbers.

Figure 8:
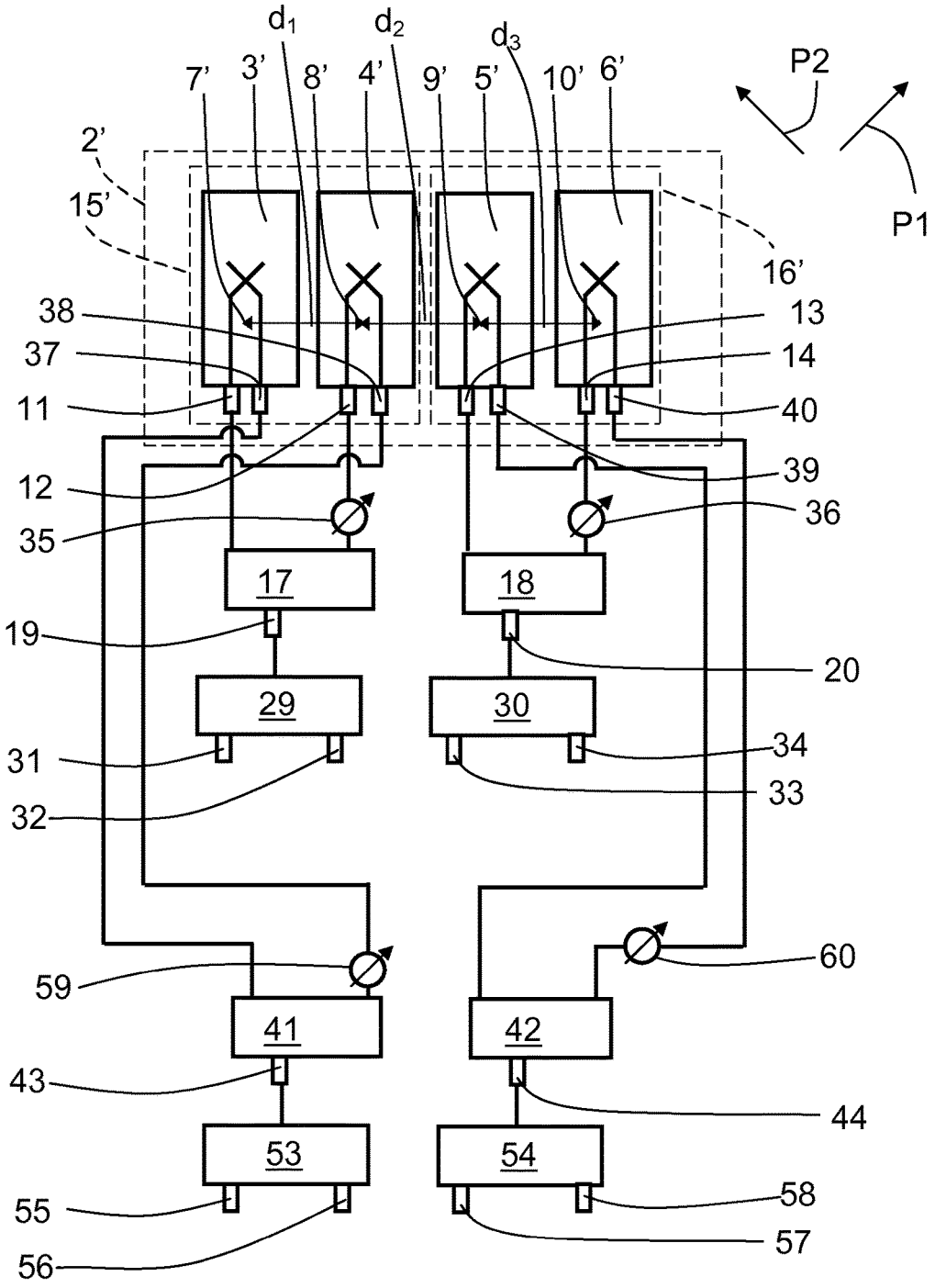
FIG. 8 shows a schematical view of an antenna arrangement according to a fifth example of the present invention.

According to the fifth example with reference to FIG. 8, the fifth common port 43 of the fifth controllable power divider/combiner 41 is connected to a third end filter device 53, and the sixth common port 44 of the sixth controllable power divider/combiner 42 is connected to a fourth end filter device 54, each end filter device 53, 54 having a respective first end filter port 55, 57 and second end filter port 56, 58. Each end filter device 53, 54 is arranged to transfer signals of a first frequency band $f_1$ between the respective common port 43, 44 and the respective first end filter port 55, 57, and to transfer signals of a second frequency band $f_2$ between the respective common port 43, 44 and the respective second end filter port 56, 58.

For the first end filter device 29 and the second end filter device 30, the first end filter ports 31, 33 may then be used for uplink signals of the first polarization P1, and the second end filter ports 32, 34 may then be used for downlink signals of the first polarization P1, as in the second example.

Furthermore, for the third end filter device 53 and the fourth end filter device 54, the first end filter ports 55, 57 may then be used for uplink signals of the second polarization P2, and the second end filter ports 56, 58 may then be used for downlink signals of the second polarization P2. The uplink signals are then using the first frequency band $f_1$ and the downlink signals are then using the second frequency band $f_2$.

Figure 9:
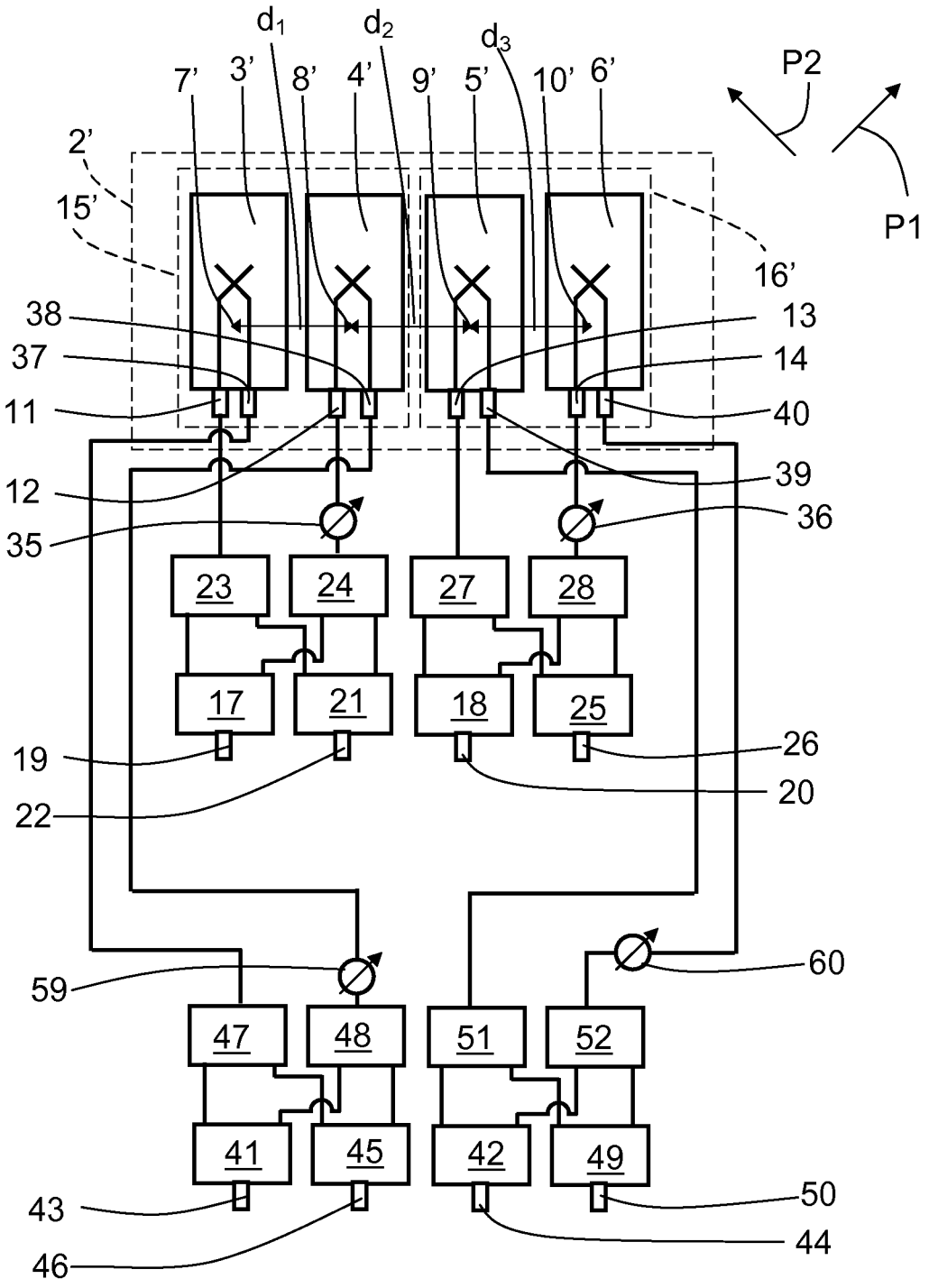
FIG. 9 shows a schematical view of an antenna arrangement according to a sixth example of the present invention.

According to a sixth example with reference to FIG. 9, different controllable power divider/combiners are used for uplink signals and downlink signals for the second polarization P2.

The sixth example corresponds to the third example above, with the addition of components for the second polarization P2. All components that relate to the first polarization P1 are the same as for the third example, and have the same reference numbers.

Here, the second antenna port 37 of the first antenna device 3' is connected to the fifth controllable power divider/combiner 41 and a seventh controllable power divider/combiner 45 having a seventh common port 46, via a fifth filter device 47. The fifth filter device 47 is arranged to, on one hand, transfer signals of a first frequency band $f_1$ between the second antenna port 37 of the first antenna device 3' and the fifth controllable power divider/combiner 41 and, on the other hand, transfer signals of a second frequency band $f_2$ between the second antenna port 37 of the first antenna device (3') and the seventh controllable power divider/combiner 45, The second antenna port 38 of the second antenna device 4' is connected to the fifth controllable power divider/combiner 41 and the seventh controllable power divider/combiner 45 via a sixth filter device 48 and the third phase shifter 59. The sixth filter device 48 is arranged to, on one hand, transfer signals of the first frequency band $f_1$ between the second antenna port 38 of the second antenna device 4' and the fifth controllable power divider/combiner 41 and, on the other hand, transfer signals of the second frequency band $f_2$ between the second antenna port 38 of the second antenna device 4' and the seventh controllable power divider/combiner 45.

The second antenna port 39 of the third antenna device 5' is connected to the sixth controllable power divider/combiner 42 and an eighth controllable power divider/combiner 49 having an eighth common port 50, via a seventh filter device 51. The seventh filter device 51 is arranged to, on one hand, transfer signals of the first frequency band $f_1$ between the second antenna port 39 of the third antenna device 5' and the sixth controllable power divider/combiner 42 and, on the other hand, transfer signals of the second frequency band $f_2$ between the second antenna port 39 of the third antenna device 5' and the eighth controllable power divider/combiner 49.

The second antenna port 40 of the fourth antenna device 6' is connected to the sixth controllable power divider/combiner 42 and the eighth controllable power divider/combiner 49, via an eighth filter device 52 and the fourth phase shifter 60. The eighth filter device 52 is arranged to, on one hand, transfer signals of the first frequency band $f_1$ between the second antenna port 40 of the fourth antenna device 6' and the sixth controllable power divider/combiner 42 and, on the other hand, transfer signals of the second frequency band $f_2$ between the second antenna port 40 of the fourth antenna device 6' and the eighth controllable power divider/combiner 49.

The first common port 19 and the second common port 20 may then be used for uplink signals of the first polarization P1, and the third common port 22 and the fourth common port 26 may then be used for downlink signals of the first polarization P1, as in the third example. Furthermore, the fifth common port 43 and the sixth common port 44 may then be used for uplink signals of the second polarization P2, and the seventh common port 46 and the eighth common port 50 may then be used for downlink signals of the second polarization P2. The uplink signals are then using the first frequency band $f_1$ and the downlink signals are then using the second frequency band $f_2$.

The present invention is not limited to the examples above, but may vary freely within the scope of the appended claims. For example the node 1 may comprise several antenna arrangements, each antenna arrangement being arranged to cover a certain sector. The sector or sectors do not have to lie in an azimuth plane, by may lie in any suitable plane, such as for example an elevation plane. In the latter case, the BPD is in an elevation plane. The antenna device 3, 4, 5, 6 are positioned in a row one after the other, where the row may lie in any suitable plane such as a horizontal plane or a vertical plane.

Each antenna device may comprise on or more antenna elements which may be placed such that they form a one-dimensional array antenna or a two-dimensional array antenna. Each antenna element may in turn be constituted by several sub-elements or even sub-arrays.

Term such as for example same, equal and orthogonal do in this context not mean to interpreted as mathematically exact, but within what is practically obtainable in this field of technology.

The phase shifters 35, 36, 59, 60 are optional, and at least some of them may either have other positions or be omitted. Furthermore, instead of phase shifters, other devices may be used to control BPD, for example mechanical rotation devices such as turntable. Due to the passive antenna architecture, the power amplifier efficiency will not be reduced when changing BW, phase center separation, or BPD of the reconfigurable antennas, which typically is the case for active antennas.

Furthermore, in order to be able to have different BPD in uplink and downlink, there may be phase shifters connected to the filter ports, or at least at the filter port side of the filter devices.

Generally, due to the optional presence of components such as phase shifters and/or filter devices, the antenna ports are at least indirectly connected to at least one respective controllable power divider/combiner, which means that the antenna ports either may be directly connected to at least one respective controllable power divider/combiner, or connected to at least one respective controllable power divider/combiner via at least one other component.

The present invention relates to a passive antenna architecture where phase center separation is automatically adapted with respect to the beamwidths. The antenna architecture may also have the possibility to achieve different phase center separation for uplink and downlink.

Due to the passive antenna architecture the power amplifier efficiency will not be reduced when changing BW, phase center separation, or BPD of the reconfigurable antennas, which typically is the case for active antennas.

The filter devices may be of any suitable kind, such as duplex filters.

The invention claimed is:

1. A node in a wireless communication system, comprising:

at least one antenna arrangement, where each antenna arrangement in turn comprises a first antenna device, a second antenna device, a third antenna device and a fourth antenna device positioned one after the other, each antenna device having a corresponding phase center where the phase centers are separated by corresponding distances, each antenna device comprising at least a corresponding first antenna port connected to a first polarization of the corresponding antenna device, wherein the first antenna device and the second antenna device form a first antenna device pair, and the third antenna device and the fourth antenna device form a second antenna device pair, wherein the first antenna ports for each antenna device pair are at least indirectly connected to at least one controllable power divider/combiner comprising a respective common port, wherein each controllable power divider/combiner is configured to adjust and/or set a corresponding power relation between the first antenna ports of the corresponding antenna device pair for power received and/or transmitted at the respective common port to control antenna beamwidths of the antenna devices in the corresponding antenna device pair, and wherein the adjusting and/or setting the corresponding power relation comprises each controllable power divider/combiner distributing power between the antenna devices of the corresponding antenna device pair.

2. The node according to claim 1, wherein a first power relation between the first antenna port of the first antenna device and the first antenna port of the second antenna device equals a second power relation between the first antenna port of the fourth antenna device and the first antenna port of the third antenna device, each power relation being related to power received and/or transmitted at the respective common port.

3. The node according to claim 1, wherein the first antenna ports of the first antenna device pair are at least indirectly connected to a first controllable power divider/combiner having a first common port, and the first antenna ports of the second antenna device pair are at least indirectly connected to a second controllable power divider/combiner having a second common port.

4. The node according to claim 3, wherein:

the first antenna port of the first antenna device is at least indirectly connected to the first controllable power divider/combiner and a third controllable power divider/combiner having a third common port, via a first filter device, the first filter device being arranged to transfer signals of a first frequency band between the first antenna port of the first antenna device and the first controllable power divider/combiner and transfer signals of a second frequency band between the first antenna port of the first antenna device and the third controllable power divider/combiner;

the first antenna port of the second antenna device is at least indirectly connected to the first controllable power divider/combiner and the third controllable power divider/combiner via a second filter device, the second filter device being arranged to transfer signals of the first frequency band between the first antenna port of the second antenna device and the first controllable power divider/combiner and transfer signals of the second frequency band between the first antenna port of the second antenna device and the third controllable power divider/combiner;

the first antenna port of the third antenna device is at least indirectly connected to the second controllable power divider/combiner and a fourth controllable power divider/combiner having a fourth common port, via a third filter device, the third filter device being arranged to transfer signals of the first frequency band between the first antenna port of the third antenna device and the second controllable power divider/combiner and transfer signals of the second frequency band between the first antenna port of the third antenna device and the fourth controllable power divider/combiner; and the first antenna port of the fourth antenna device is at least indirectly connected to the second controllable power divider/combiner and the fourth controllable power divider/combiner, via a fourth filter device, the fourth filter device being arranged to transfer signals of the first frequency band between the first antenna port of the fourth antenna device and the second controllable power divider/combiner and transfer signals of the second frequency band between the first antenna port of the fourth antenna device and the fourth controllable power divider/combiner.

5. The node according to claim 3, wherein each common port is connected to a corresponding end filter device, each end filter device being arranged to transfer signals of a first frequency band between the respective common port and a respective first end filter port, and to transfer signals of a second frequency band between the respective common port and a respective second end filter port.

6. The node according to claim 1, wherein for the first antenna pair, there is at least a first phase shifter connected to an antenna port, and for the second antenna pair, there is at least a second phase shifter connected to an antenna port.

7. The node according to claim 1, wherein each antenna device comprises a corresponding second antenna port connected to a second polarization of the corresponding antenna device, where the first polarization and the second polarization are mutually orthogonal, and where, for each antenna device pair, the second antenna ports are at least indirectly connected to a respective controllable power divider/combiner having a respective common port, each controllable power divider/combiner being arranged to adjust and/or set a corresponding power relation between the second antenna ports of the corresponding antenna device pair for power received and/or transmitted at its common port.

8. The node according to claim 7, wherein a third power relation between the second antenna port of the first antenna device and the second antenna port of the second antenna device equals a fourth power relation between the second antenna port of the fourth antenna device and the second antenna port of the third antenna device, each power relation being related to power received and/or transmitted at the respective common port.

9. The node according to claim 7, wherein the second antenna ports of the first antenna device pair are at least indirectly connected to a fifth controllable power divider/combiner having a fifth common port, and in that the second antenna ports of the second antenna device pair are at least indirectly connected to a sixth controllable power divider/combiner having a sixth common port.

10. The node according to claim 9, wherein:

the second antenna port of the first antenna device is at least indirectly connected to the fifth controllable power divider/combiner and a seventh controllable power divider/combiner having a seventh common port, via a fifth filter device, the fifth filter device being arranged to transfer signals of a first frequency band between the second antenna port of the first antenna device and the fifth controllable power divider/combiner and, transfer signals of a second frequency band between the second antenna port of the first antenna device and the seventh controllable power divider/combiner;

the second antenna port of the second antenna device is at least indirectly connected to the fifth controllable power divider/combiner and the seventh controllable power divider/combiner via a sixth filter device, the sixth filter device being arranged to transfer signals of the first frequency band between the second antenna port of the second antenna device and the fifth controllable power divider/combiner and transfer signals of the second frequency band between the second antenna port of the second antenna device and the seventh controllable power divider/combiner;

the second antenna port of the third antenna device is at least indirectly connected to the sixth controllable power divider/combiner and an eighth controllable power divider/combiner having an eighth common port, via a seventh filter device, the seventh filter device being arranged to transfer signals of the first frequency band between the second antenna port of the third antenna device and the sixth controllable power divider/combiner and transfer signals of the second frequency band between the second antenna port of the third antenna device and the eighth controllable power divider/combiner; and the second antenna port of the fourth antenna device is at least indirectly connected to the sixth controllable power divider/combiner and the eighth controllable power divider/combiner, via an eighth filter device, the eighth filter device being arranged to transfer signals of the first frequency band between the second antenna port of the fourth antenna device and the sixth controllable power divider/combiner and transfer signals of the second frequency band between the second antenna port of the fourth antenna device and the eighth controllable power divider/combiner.

11. The node according to claim 9, wherein each common port of the fifth controllable power divider/combiner and the sixth controllable power divider/combiner is connected to a corresponding end filter device, each end filter device being arranged to transfer signals of a first frequency band between the respective common port and a respective first end filter port, and to transfer signals of a second frequency band between the respective common port and a respective second end filter port.

12. The node according to claim 7, wherein for the first antenna pair, there is at least a third phase shifter connected to a second antenna port, and for the second antenna pair, there is at least a second phase shifter connected to an antenna port.

* * * * *